US008212246B2

(12) United States Patent
Tao et al.

(10) Patent No.: US 8,212,246 B2
(45) Date of Patent: Jul. 3, 2012

(54) N-TYPE DOPING IN METAL OXIDES AND METAL CHALCOGENIDES BY ELECTROCHEMICAL METHODS

(75) Inventors: Meng Tao, Colleyville, TX (US); Xiaofei Han, Arlington, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 362 days.

(21) Appl. No.: 12/540,933

(22) Filed: Aug. 13, 2009

(65) Prior Publication Data

US 2010/0038638 A1 Feb. 18, 2010

Related U.S. Application Data

(60) Provisional application No. 61/088,528, filed on Aug. 13, 2008.

(51) Int. Cl.
*H01L 29/10* (2006.01)

(52) U.S. Cl. ..... 257/43; 257/E21.276; 257/E31.029; 438/104; 438/408; 438/466

(58) Field of Classification Search ..... None
See application file for complete search history.

(56) References Cited

U.S. PATENT DOCUMENTS

2002/0171788 A1* 11/2002 Lin et al. ..... 349/96
2008/0163929 A1* 7/2008 Krasnov ..... 136/265
2010/0132772 A1* 6/2010 Asano et al. ..... 136/252

OTHER PUBLICATIONS

Minami, Tadatsugu et al., Highly transparent and conductive rare earth-doped ZnO thin films prepared by magnetron sputtering, Thin Solid Films 366, 2000, pp. 63-68.
Kaur, R. et al., Development of highly transparent and conducting yttrium-doped ZnO films: the role of sol-gel stabilizers, Materials Science-Poland, vol. 22, No. 3, 2004, pp. 201-209.

* cited by examiner

*Primary Examiner* — Benjamin Sandvik
*Assistant Examiner* — Scott R Wilson
(74) *Attorney, Agent, or Firm* — Chowdhury & Georgakis, P.C.

(57) ABSTRACT

Methods and systems for electrochemically depositing doped metal oxide and metal chalcogenide films are disclosed. An example method includes dissolving a metal precursor into a solution, adding a halogen precursor to the solution, and applying a potential between a working electrode and a counter electrode of an electrochemical cell to deposit halogen doped metal oxide or metal chalcogenide onto a substrate. Another example method includes dissolving a zinc precursor into a solution, adding an yttrium precursor to the solution, and applying a potential between a working electrode and a counter electrode of an electrochemical cell to deposit yttrium doped zinc oxide onto a substrate. Other embodiments are described and claimed.

20 Claims, 9 Drawing Sheets

N-TYPE DOPING IN METAL OXIDES AND METAL CHALCOGENIDES BY ELECTROCHEMICAL METHODS

CROSS REFERENCE TO RELATED APPLICATIONS

This application claims the benefit of the filing date of U.S. provisional patent application No. 61/088,528, incorporated herein by reference, which was filed on Aug. 13, 2008, by the same inventors of this application.

FIELD OF THE INVENTION

The present invention relates generally to the field of electrochemical doping in metal oxides and metal chalcogenides.

SUMMARY

In one respect, disclosed is a method for electrochemical doping in metal oxides and metal chalcogenides. The method may include operations such as dissolving a metal precursor into a solution; adding a complexing agent to the solution; adjusting pH of the solution; controlling the temperature of the solution; adding a halogen precursor to the solution; and applying a potential between a working electrode and a counter electrode of an electrochemical cell to deposit halogen doped metal oxide or metal chalcogenide film.

In another respect, disclosed is a semiconductor device comprising an electrochemically doped metal oxide or metal chalcogenide film, deposited according a process like that described immediately above.

In yet another respect, disclosed is a method for electrochemical doping in metal oxides. The method may include operations such as dissolving a zinc precursor into a solution; controlling the temperature of the solution; adding an yttrium precursor to the solution and performing a cyclic voltammetry; and applying a potential between a working electrode and a counter electrode of an electrochemical cell to deposit yttrium doped zinc oxide film.

In another respect, disclosed is a semiconductor device comprising an yttrium doped zinc oxide film, deposited according a process like that described immediately above.

Numerous additional embodiments are also possible.

BRIEF DESCRIPTION OF THE DRAWINGS

Features and advantages of the present invention will become apparent from the appended claims, the following detailed description of one or more example embodiments, and the corresponding figures.

DETAILED DESCRIPTION OF ONE OR MORE EMBODIMENTS

Figure 1:
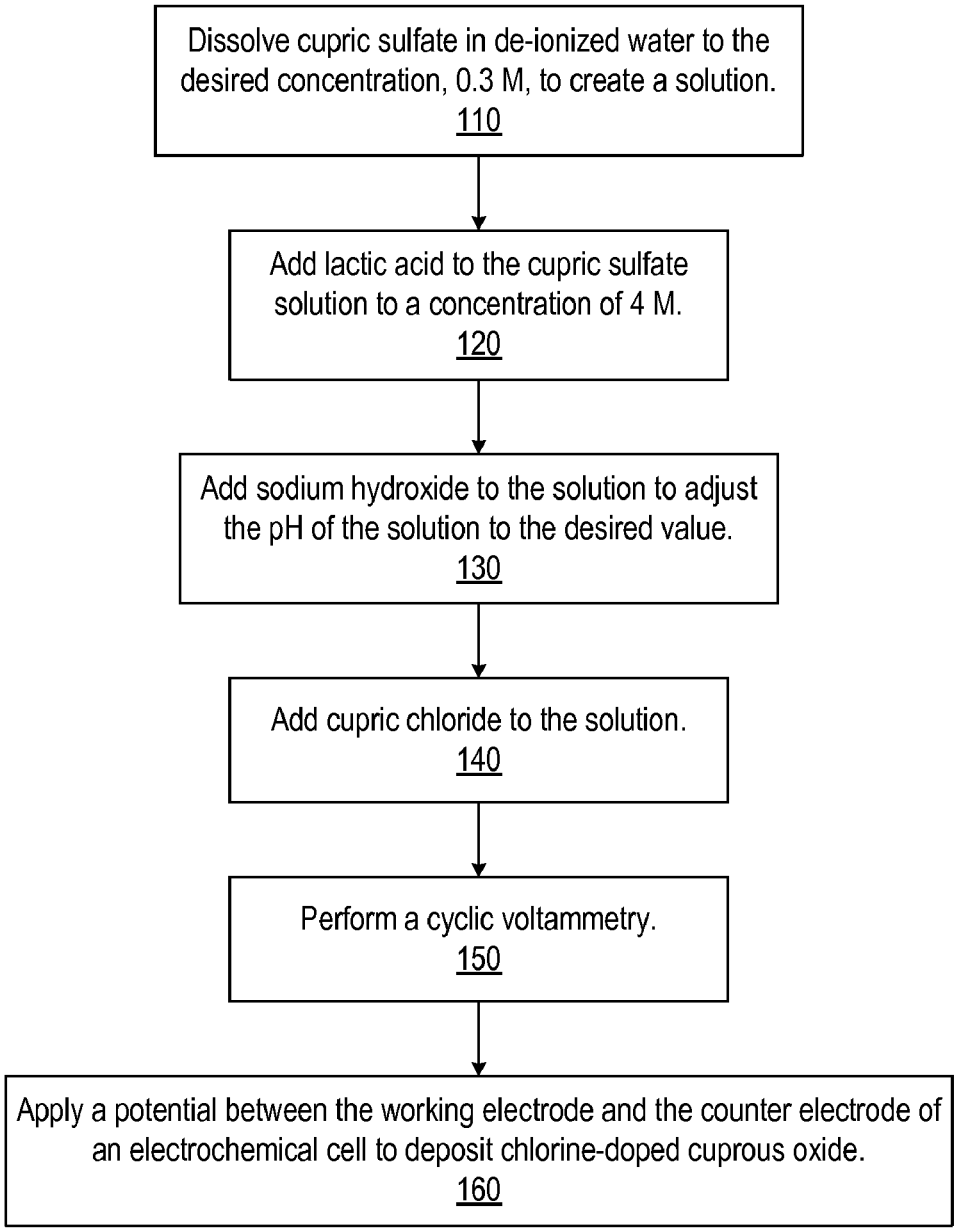
FIG. 1 is a block diagram illustrating electrochemical deposition of chlorine-doped cuprous oxide films on copper substrates with cupric chloride, in accordance with some embodiments.

The drawing figures are not necessarily to scale and certain features may be shown exaggerated in scale or in somewhat generalized or schematic form in the interest of clarity and conciseness. In the description which follows like parts may be marked throughout the specification and drawing with the same reference numerals. The foregoing description of the figures is provided for a more complete understanding of the drawings. It should be understood, however, that the embodiments are not limited to the precise arrangements and configurations shown. Although the design and use of various embodiments are discussed in detail below, it should be appreciated that the present invention provides many inventive concepts that may be embodied in a wide variety of contexts. The specific aspects and embodiments discussed herein are merely illustrative of ways to make and use the invention, and do not limit the scope of the invention. It would be impossible or impractical to include all of the possible embodiments and contexts of the invention in this disclosure. Upon reading this disclosure, many alternative embodiments of the present invention will be apparent to persons of ordinary skill in the art.

In some embodiments, electrochemical deposition methods are utilized for n-type doping in metal oxides and metal chalcogenides. The electrochemical deposition is performed in a three-electrode electrochemical cell comprising a working electrode, a counter electrode, and a reference electrode, where the reference electrode allows the manufacturer to determine the exact potential being applied for deposition. The deposition technique is capable of controlling the conduction type (n-type or p-type) of the metal oxides and metal chalcogenides as well as the conductivity of the metal oxides and metal chalcogenides. Having the ability to control conduction type and conductivity is important for the fabrication of structures such as homogenous p-n junctions and transparent conductive oxides, which are key components for high performance electronic, photovoltaic, and optoelectronic devices.

Electrochemical deposition offers low cost, scalability, and large area processing capability. Electrochemically deposited films may be denser and may have lower resistivities than those prepared by other chemical methods, due to the fact that the film has to be electrically continuous for deposition to proceed. Since electrochemically deposited films are denser and have lower resistivities, post deposition annealing temperatures can also be lower. In addition, unlike other chemical methods, monitoring the amount of charge transferred for the deposition allows precise and in-line control of the film thickness. Film thickness control is important for transparent conductive oxide films which serve as the antireflection layer in thin-film solar cells.

Electrochemical doping techniques like those described herein may be used to form n-type metal oxides and chalcogenides for solar cells with high efficiency and low cost. For instance, n-type structures may be created without using a vacuum. The techniques described herein may also be used to form a transparent or substantially transparent conductive layer over a substrate without using a vacuum. For example, a transparent conductive oxide (TCO) layer may be formed as a component in photovoltaic solar cells, including thin-film solar cells, in high-frequency piezoelectric resonators, in light emitting diodes (LEDs), and in other devices.

In metal oxides and metal chalcogenides, the anion (i.e., oxygen or chalcogen) has a valence of −2, meaning the anion closes its outer shell by taking in two electrons from a metal cation. In principle, any halogen from Group VII in the periodic table (i.e., fluorine, chlorine, bromine and iodine) can be an n-type dopant in metal oxides and metal chalcogenides, if it substitutes the anion. A halogen in metal oxides and metal chalcogenides has a valence of −1, meaning the halogen closes its outer shell by taking in one electron from a metal cation. Since the halogen only takes in one electron from the cation when the halogen substitutes an oxygen or chalcogen anion, the second electron from a metal cation will be a free electron. The halogen anion is an electron donor and thus an n-type dopant. By adding a halogen into the electrolyte solution during electrochemical deposition, n-type doping in metal oxides and metal chalcogenides is achieved. The conductivity of the doped metal oxides and metal chalcogenides is controlled by the amount of halogen incorporated during the electrochemical deposition.

Zinc oxide is an n-type semiconductor with a bandgap of 3.3 eV. In zinc oxide, the cation, zinc, has a valence of +2, meaning that each cation donates two electrons to oxygen. In principle, any element from Group III in the periodic table, i.e. aluminum, gallium, indium, scandium and yttrium, can be an n-type dopant in zinc oxide, if they substitute the cation. For the case of an yttrium atom in zinc oxide, a valence of +3 means that each yttrium atom can donate one electron to the conduction band, thus reducing the resistivity of zinc oxide.

FIG. 1 is a block diagram illustrating electrochemical deposition of chlorine-doped cuprous oxide films on copper substrates with cupric chloride, in accordance with some embodiments.

In some embodiments, the metal precursor cupric sulfate is first dissolved in de-ionized water to a desired concentration of 0.3 M to create a solution, as shown at block 110. Next, a complexing agent lactic acid is added to the cupric sulfate solution to a concentration of 4 M, as shown at block 120. The lactic acid serves as a complexing agent to prevent copper precipitation when sodium hydroxide is added to the solution. As shown at block 130, the pH of the solution is adjusted to the desired value by adding sodium hydroxide to the solution. To deposit n-type cuprous oxide, the pH value of the solution is kept below 9. In particular, as shown at block 140, the halogen precursor cupric chloride is added to the solution.

In addition, as shown at block 150, prior to the deposition, cyclic voltammetry may be performed to determine the potential to apply for the deposition of chlorine doped cuprous oxide. As indicated below, in an example embodiment, cyclic voltammetry reveals the potential range of −0.05 V to −0.25 V versus the reference electrode. The mole concentration of cupric chloride in the solution is adjusted to control the amount of chlorine ultimately incorporated into the cuprous oxide film and thus the conductivity of the film. Chlorine-doped cuprous oxide is deposited on the substrate by applying a potential between the working electrode and the counter electrode of a three-electrode electrochemical cell, as shown at block 160. In one embodiment, the electrochemical cell has a copper substrate working electrode, a platinum foil counter electrode, and a reference electrode having a silver wire in a solution of potassium chloride saturated with solid silver chloride. For such an electrochemical cell, the manufacturer may apply a potential between the working electrode and the counter electrode in the range of −0.05 V to −0.25 V versus the reference electrode. Other types of electrochemical cells may be used in alternative embodiments.

There are two reduction reactions for cupric ions; one reduces cupric ions to cuprous ions and the other reduces cupric ions to metallic copper. The cuprous ions react with hydroxyl ions in the solution to form cuprous oxide and with chlorine ions in the solution to form insoluble cuprous chloride, which incorporates chlorine into the cuprous oxide film. Performing the deposition as shown in blocks 110 to 160 with 0.1 M cupric chloride in an electrolyte solution at 60° C., a pH of 8, and a −0.1 V deposition potential, results in a film thickness of about 200 nm after one hour.

Figure 2A:
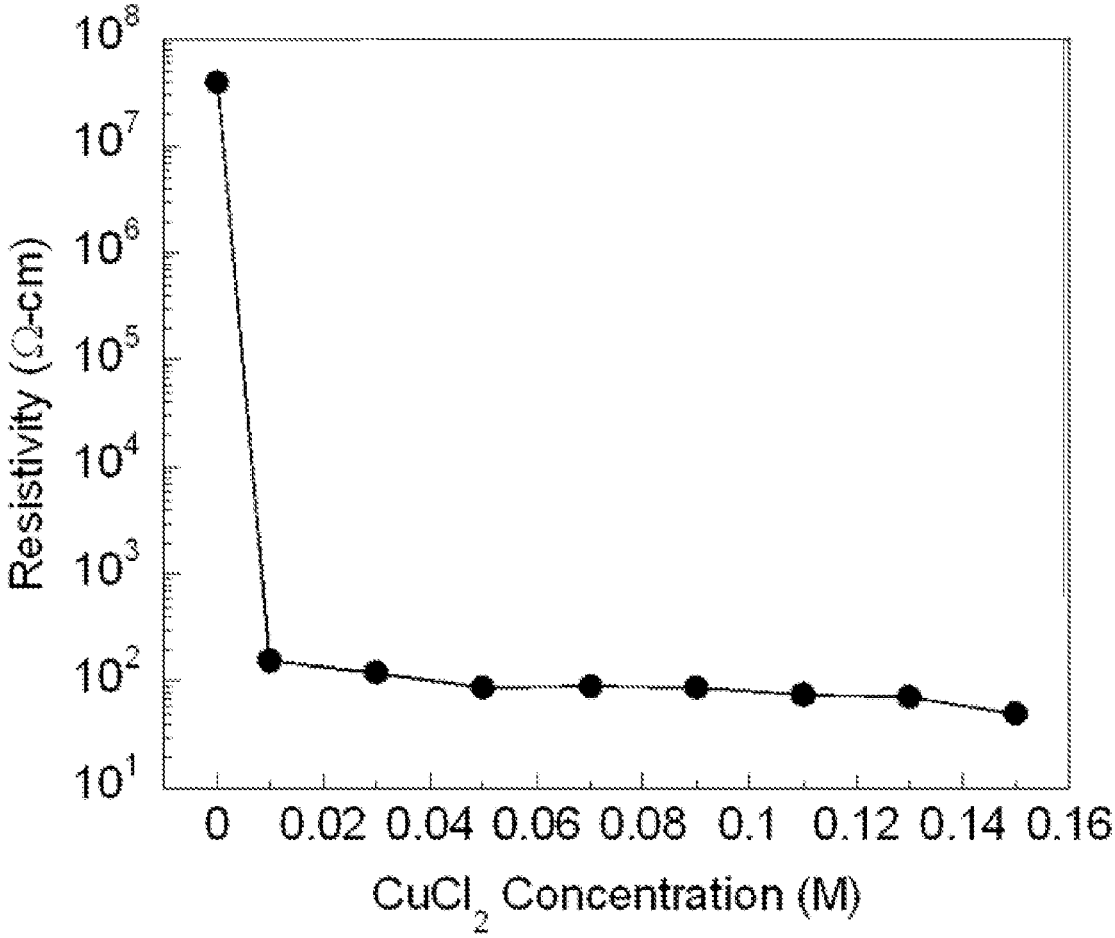
FIGS. 2(*a*) and (*b*) are graphs showing the effect of chloride mole concentration in the solution on resistivity of electrochemically-deposited cuprous oxide, in accordance with some embodiments.
Figure 2B:
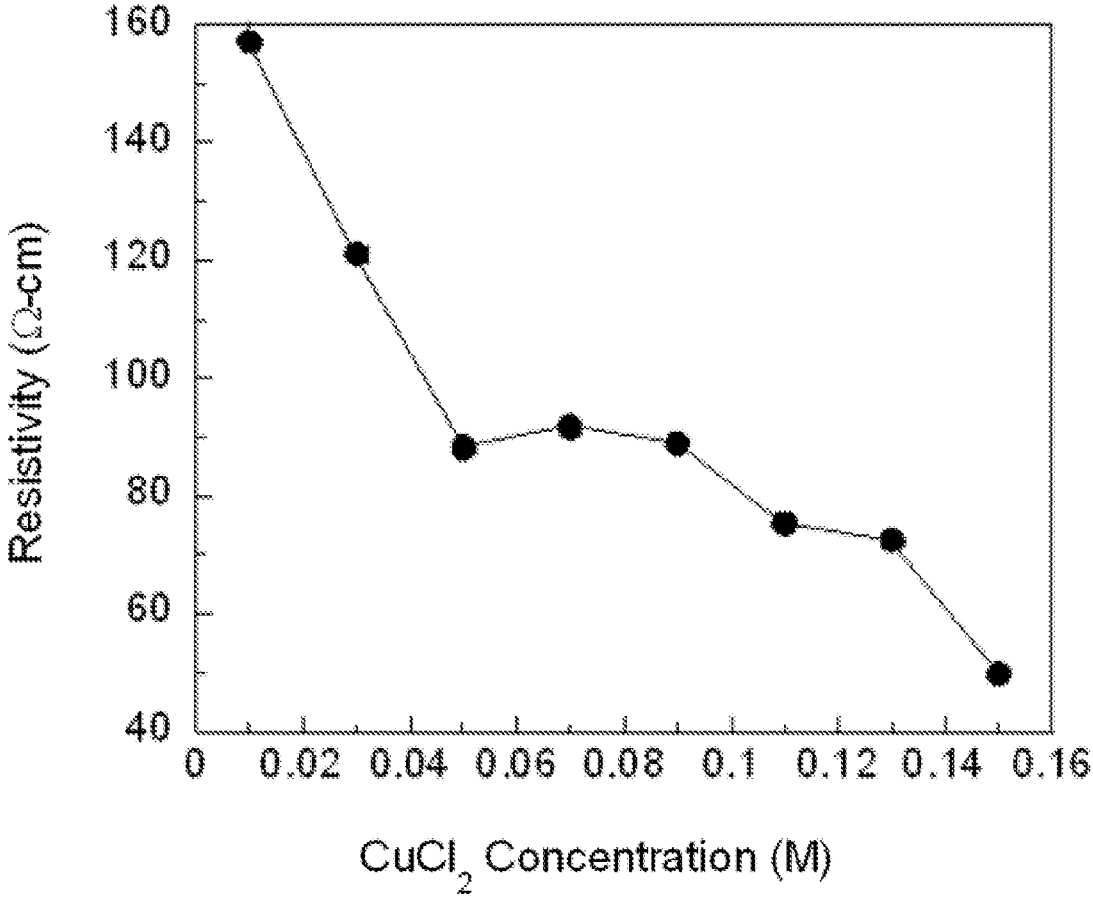

FIGS. 2(*a*) and (*b*) are graphs showing the effect of chloride mole concentration in the solution on resistivity of electrochemically-deposited cuprous oxide, in accordance with some embodiments.

In some embodiments, the most critical parameter in controlling the amount of chlorine incorporated into cuprous oxide is the mole concentration of cupric chloride in the solution. With a higher chloride mole concentration, the amount of chlorine incorporated into the cuprous oxide film increases, thus decreasing the resistivity of the film. With a lower chloride mole concentration, the amount of chlorine incorporated into the cuprous oxide film decreases, thus increasing the resistivity of the film. FIGS. 2(*a*) shows a logarithmic plot of the resistivity of chlorine-doped cuprous oxide films as a function of chloride mole concentration in the solution in the range from 0 M to 0.15 M. Without doping, the resistivity of cuprous oxide is 40 MΩ-cm. Adding chlorine doping results in an over five orders of magnitude reduction in cuprous oxide resistivity. FIG. 2(*b*) shows a linear plot of the resistivity of chlorine-doped cuprous oxide films as a function of chloride mole concentration in the solution in the range from 0.01 M to 0.15 M. Between this range, the resistivity is reduced from about 157 Ω-cm to about 48 Ω-cm. Both FIGS. 2(*a*) and (*b*) had deposition conditions of 0.3 M cupric sulfate concentration, 4 M lactic acid concentration, a solution pH of 7.5 and temperature of 60° C., a deposition potential of −0.1 V versus the reference electrode, and a deposition time of one hour.

Figure 3:
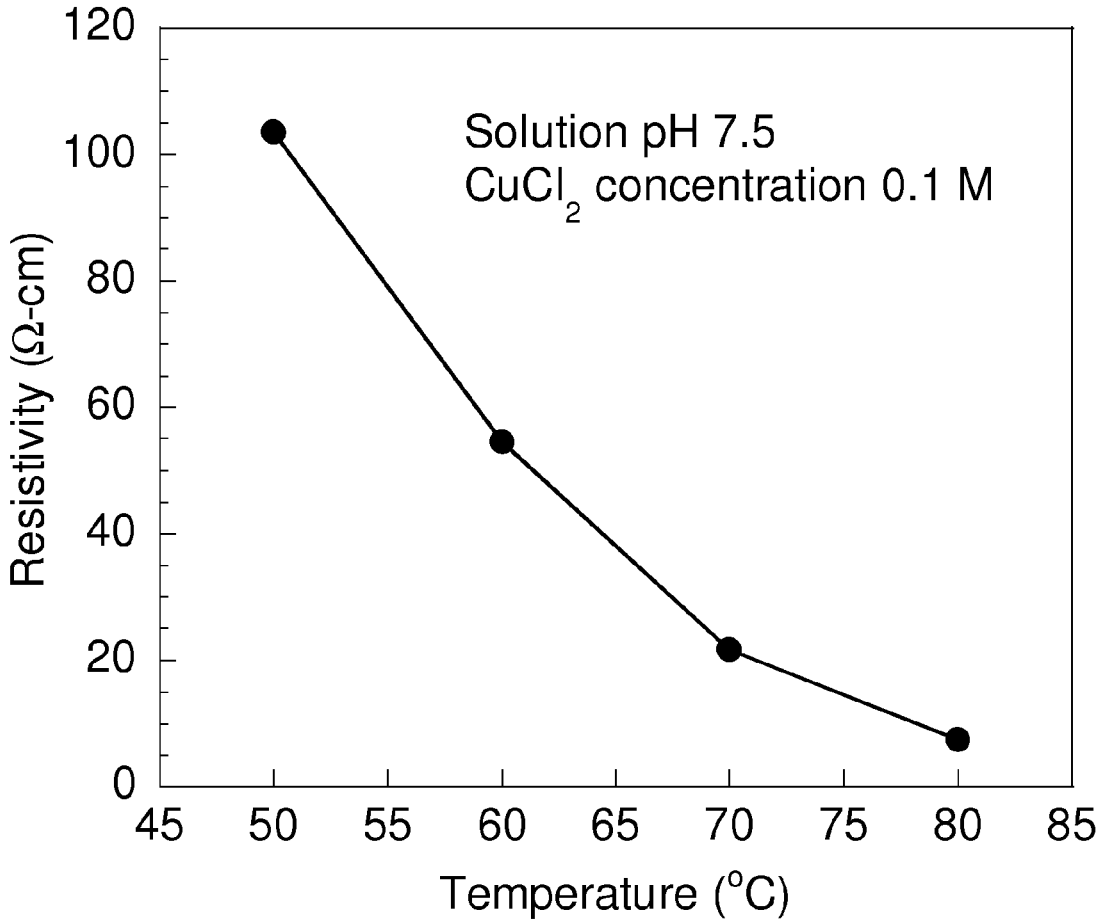
FIG. 3 is a graph showing the effect of deposition temperature on resistivity of chlorine-doped cuprous oxide by electrochemical deposition, in accordance with some embodiments.

FIG. 3 is a graph showing the effect of deposition temperature on resistivity of chlorine-doped cuprous oxide by electrochemical deposition, in accordance with some embodiments.

In some embodiments, the growth rate and grain size of the polycrystalline cuprous oxide films is primarily affected by the solution temperature during deposition. As the solution temperature increases, the growth rate and grain size also increase. Large grains improve the electrical properties of the film, such as carrier mobility and minority carrier lifetime. FIG. 3 shows a plot of the resistivity of chlorine-doped cuprous oxide films as a function of solution temperature during deposition. The resistivity of chlorine-doped cuprous oxide is reduced from about 103 Ω-cm to about 7 Ω-cm, between 50° C. and 80° C. FIG. 3 had deposition conditions of 0.3 M cupric sulfate concentration, 4 M lactic acid concentration, a solution pH of 7.5, a cupric chloride concentration of 0.1 M, a deposition potential of −0.1 V versus the reference electrode, and a deposition time of one hour.

Figure 4:
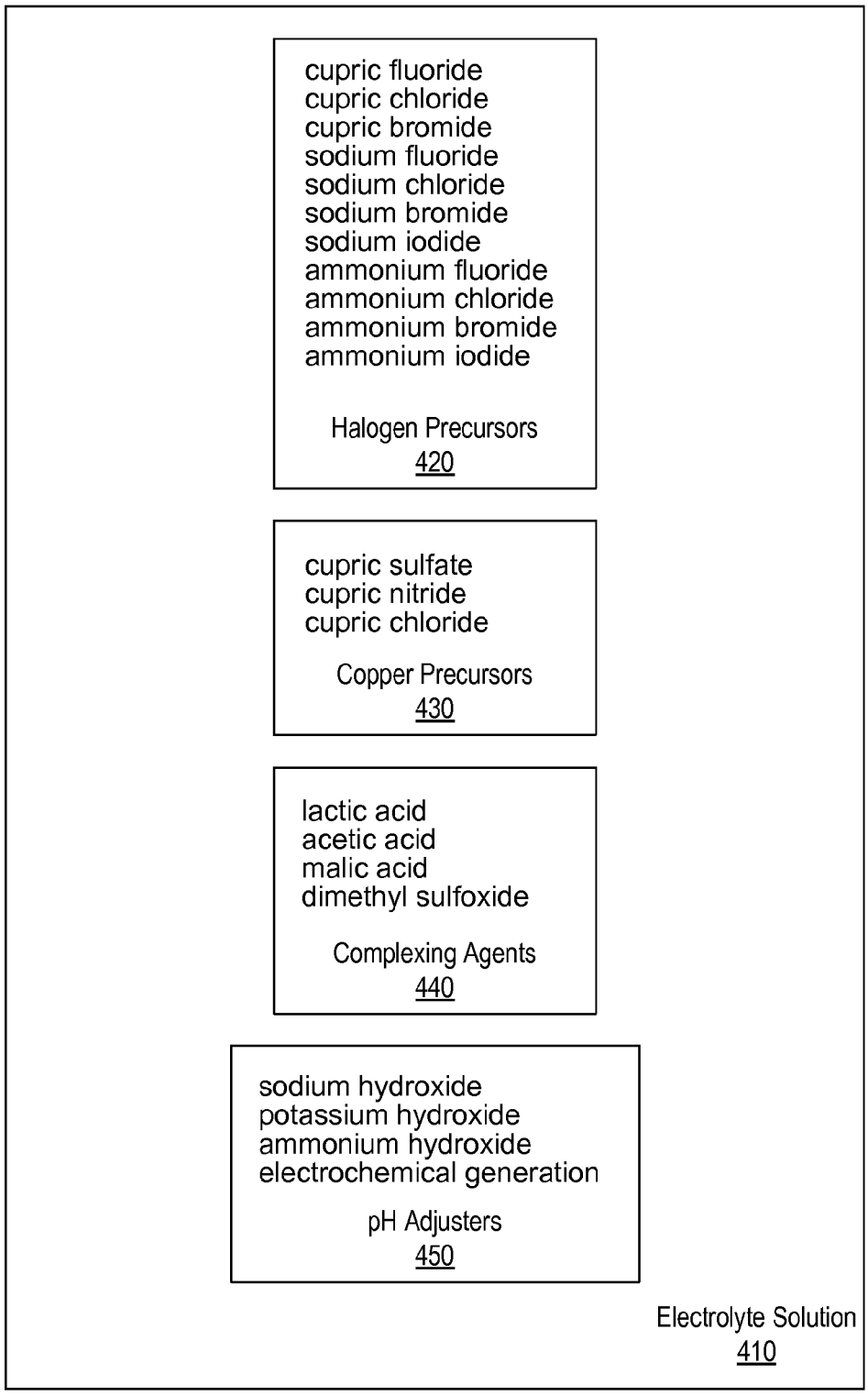
FIG. 4 is a chart listing some representative chemicals used as components of the electrolyte solution for chlorine doped cuprous oxide.

FIG. 4 is a chart listing some representative chemicals used as components of the electrolyte solution. As shown in block 410, in some embodiments the electrolyte solution includes a halogen precursor, a metal precursor, a complexing agent, and a pH adjuster. In principle, any halogen can serve as an n-type dopant in metal oxides and metal chalcogenides if it substitutes the anion, i.e. oxygen or chalcogen. For n-type doping in electrochemical deposition, the halogen precursor needs to be soluble in the electrolyte solution and the product should have a low solubility in the solution. A partial list of halogen precursors for halogen doped cuprous oxide includes cupric fluoride, cupric chloride, cupric bromide, sodium fluoride, sodium chloride, sodium bromide, sodium iodide, ammonium fluoride, ammonium chloride, ammonium bromide, and ammonium iodide, as shown in block 420. For the metal precursor for cuprous oxide, a partial list of chemicals includes cupric sulfate, cupric nitride, and cupric chloride, as shown in block 430. A partial list of complexing agents for cuprous includes lactic acid, acetic acid, malic acid, and dimethyl sulfoxide, as shown in block 440. Finally, some sources for hydroxyl ions include sodium hydroxide, potassium hydroxide, ammonium hydroxide, and even electrochemical generation of hydroxyl ions, as shown in block 450. In electrochemical depositions where hydroxyl ions are electrochemically generated, for example by reducing water, the ratio of hydroxyl ions to chlorine ions in the solution can be controlled by both the concentration of chloride and the rate of water reduction. Fast water reduction by a large electrical current and a low concentration of chlorine ions reduces the amount of chlorine incorporated into the metal oxide or chalcogenide film, thus resulting in a film with high resistivity. On the other hand, slow water reduction and a high concentration of chlorine ions increases the amount of chlorine incorporated into the metal oxide or chalcogenide film, thus resulting in a film with lower resistivity. For example, with nitrate ions in an aqueous solution, electrochemical reduction of nitrate ions produces hydroxyl ions. By controlling the rate of this reaction and the chlorine concentration, the amount of chlorine incorporated in electrochemical deposition can be controlled.

Figure 5:
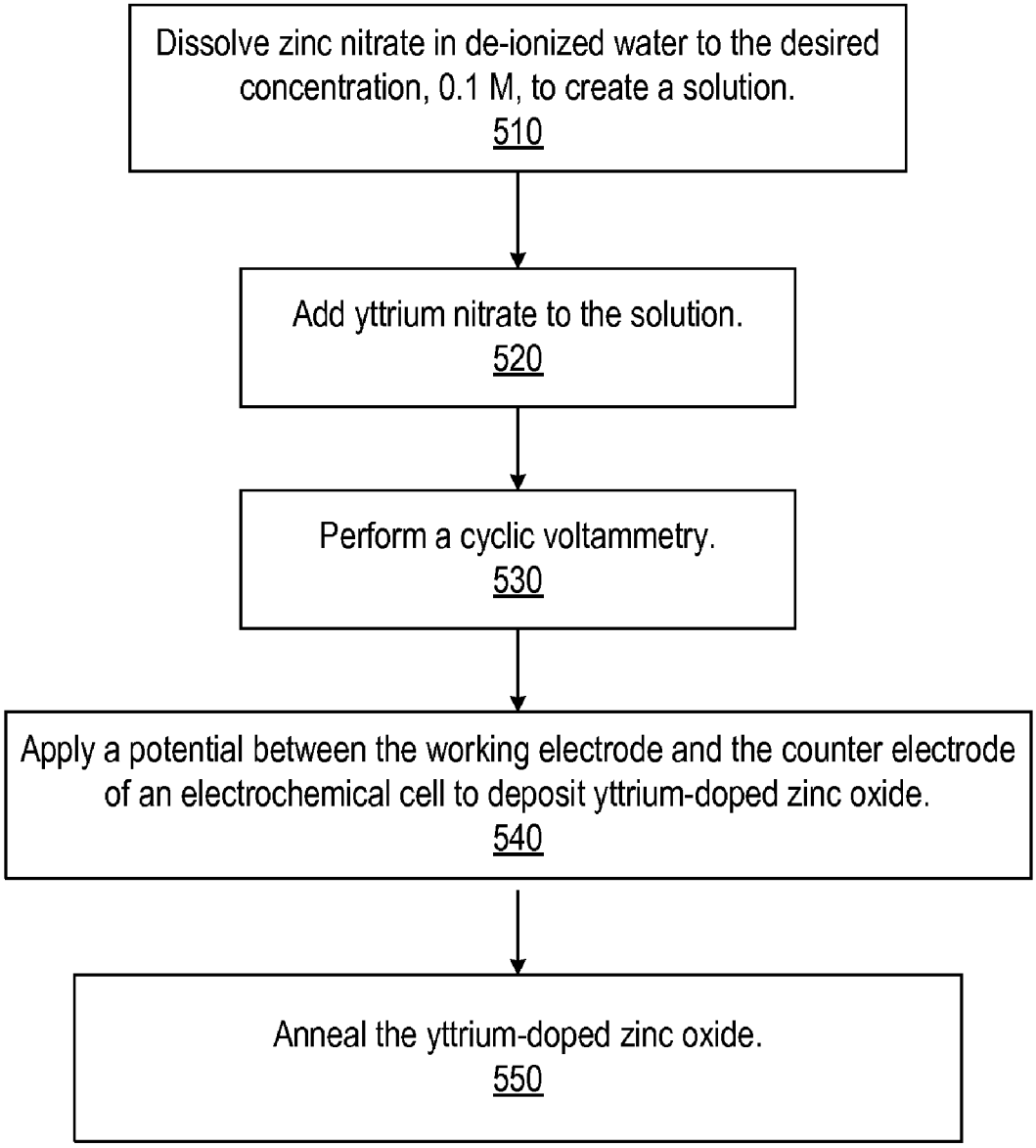
FIG. 5 is a block diagram illustrating electrochemical deposition of yttrium-doped zinc oxide films on indium tin oxide substrates with yttrium nitrate, in accordance with some embodiments.

FIG. 5 is a block diagram illustrating electrochemical deposition of yttrium-doped zinc oxide films on indium tin oxide substrates with yttrium nitrate, in accordance with some embodiments.

In some embodiments, the zinc precursor zinc nitrate is first dissolved in de-ionized water to a desired concentration of 0.1 M to create a solution, as shown in block 510. In one embodiment, this solution has a pH of around 5. Next the yttrium precursor yttrium nitrate is added to the solution, as shown in block 520, and cyclic voltammetry is performed prior to the deposition, as shown in block 530.

As shown at block 540, deposition of yttrium-doped zinc oxide is achieved by applying a potential between the working electrode and the counter electrode of a three-electrode electrochemical cell. In some embodiments, the electrochemical cell has an indium tin oxide (ITO) substrate working electrode, a platinum foil counter electrode, and a reference electrode having a silver wire in a solution of potassium chloride saturated with solid silver chloride. For such an electrochemical cell, the manufacturer may apply a potential in the range of −0.4 V to −0.8 V versus the reference electrode to cause the deposition of yttrium-doped zinc oxide on the substrate. Other types of electrochemical cells may be used in alternative embodiments.

The mole concentration of yttrium nitrate in the solution is adjusted to control the amount of yttrium ultimately incorporated into the zinc oxide film and thus the resistivity of the film. There are two reduction reactions in this potential range; one reduces nitrate ions to hydroxyl ions and the other reduces zinc ions to metallic zinc. The zinc ions react with hydroxyl ions in the solution to form zinc oxide and the yttrium ions also react with hydroxyl ions in the solution to form yttrium oxide, which incorporates yttrium into the zinc oxide film. Performing the deposition as shown in blocks 510 to 540 with 0.1 M zinc nitrate, 0.16 mM yttrium nitrate, in an electrolyte solution at 70° C., a pH of about 5, and a −0.7 V deposition potential, results in a film thickness of about 400 nm after one hour. As shown at block 550, the yttrium-doped zinc oxide may then be annealed.

Figure 6:
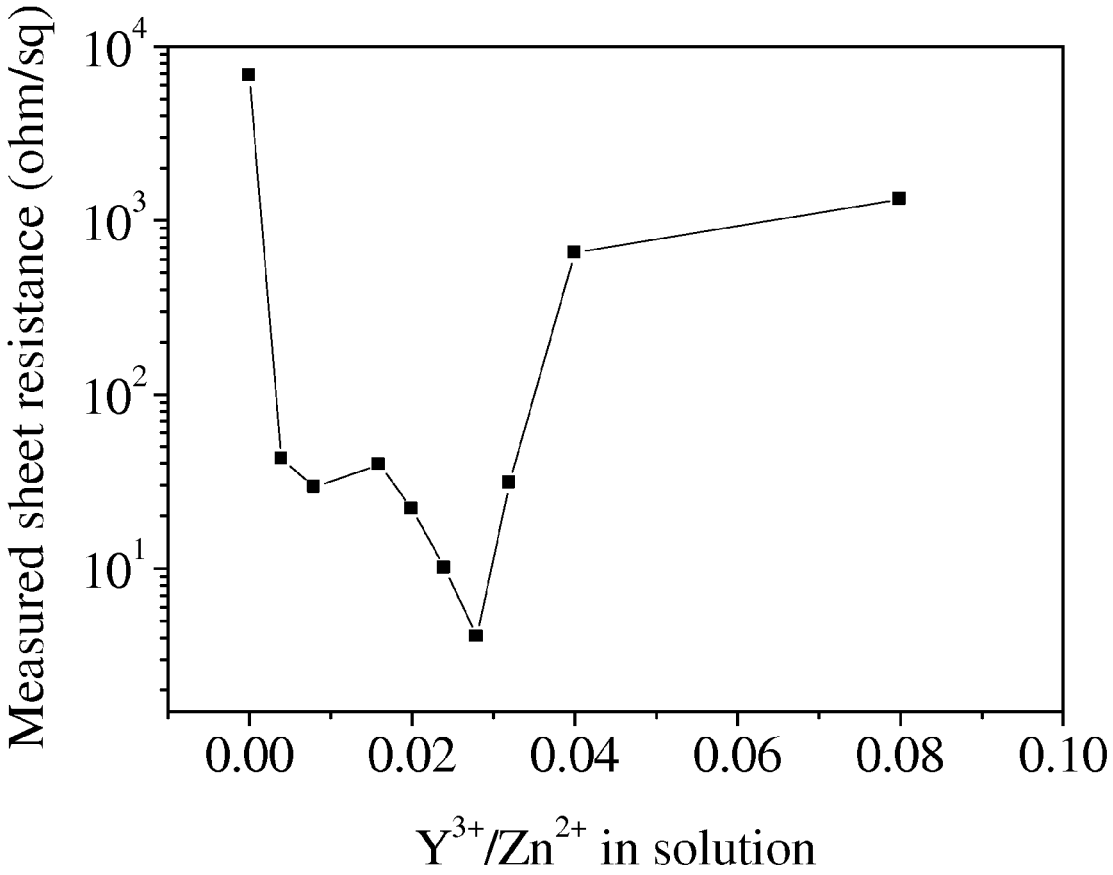
FIG. 6 is a graph showing the effect of yttrium mole concentration in the solution on sheet resistance of electrochemically-deposited zinc oxide after post-deposition annealing in air, in accordance with some embodiments.

FIG. 6 is a graph showing the effect of yttrium mole concentration in the solution on sheet resistance of electrochemically-deposited zinc oxide after post-deposition annealing in air, in accordance with some embodiments.

In some embodiments, there exists an optimum yttrium/zinc ($Y^{3+}/Zn^{2+}$) mole ratio at which the sheet resistance goes to a minimum for post-deposition annealing in air. This optimum yttrium/zinc ratio is about 0.028. Between undoped zinc oxide and an yttrium/zinc ratio of 0.028, the sheet resistance is reduced from 6 kΩ/□ (kΩ per square) to 4Ω/□. The resistivity of zinc oxide is thus reduced from $9\times10^{2}$ Ω-cm to $8.2\times10^{-4}$ Ω-cm. FIG. 6 shows the sheet resistance of yttrium-doped zinc oxide as a function of yttrium mole concentration in the solution for deposition conditions of: a solution temperature of 70° C., a deposition potential of −0.7 V versus the silver/silver chloride/saturated potassium chloride reference electrode, a deposition time of one hour, a zinc nitrate concentration of 0.1 M, and a post anneal in air at 200° C. for three hours.

Figure 7:
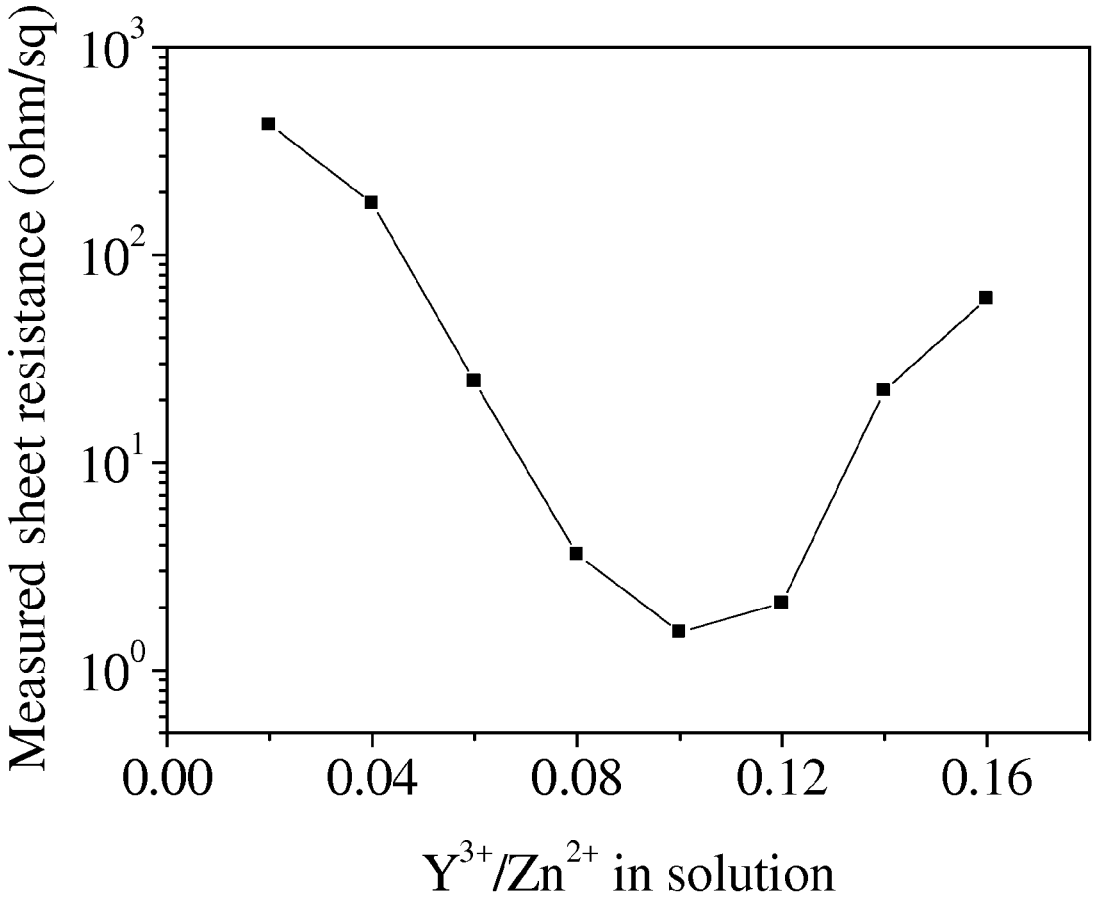
FIG. 7 is a graph showing the effect of yttrium mole concentration in the solution on sheet resistance of electrochemically-deposited zinc oxide after post-deposition annealing in nitrogen gas, in accordance with some embodiments.

FIG. 7 is a graph showing the effect of yttrium mole concentration in the solution on sheet resistance of electrochemically-deposited zinc oxide after post-deposition annealing in nitrogen gas, in accordance with some embodiments.

In some embodiments, there exists an optimum yttrium/zinc mole ratio at which the sheet resistance goes to a minimum for post-deposition annealing in nitrogen. This optimum yttrium/zinc ratio is about 0.09. For an yttrium/zinc ratio of 0.09, the sheet resistance is 1.5Ω/□, which corresponds to a resistivity of $2.2\times10^{-4}$ Ω-cm for zinc oxide. FIG. 7 shows the sheet resistance of yttrium-doped zinc oxide as a function of yttrium mole concentration in the solution for deposition conditions of: a solution temperature of 70° C., a deposition potential of −0.7 V versus the silver/silver chloride/saturated potassium chloride reference electrode, a deposition time of one hour, a zinc nitrate concentration of 0.1 M, and a post anneal in nitrogen at 300° C. for three hours.

Figure 8:
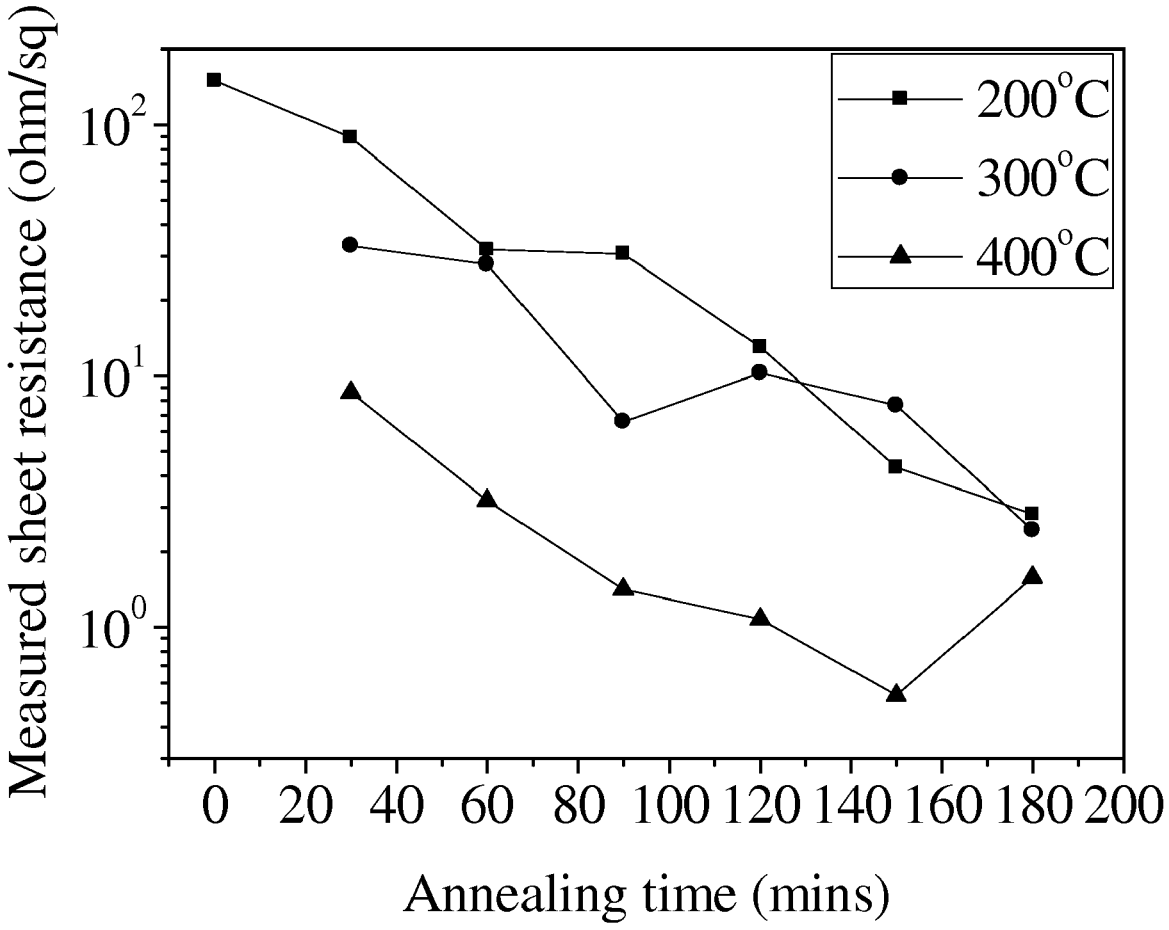
FIG. 8 is a graph showing the effect of post-deposition annealing temperature in nitrogen and annealing time on sheet resistance of yttrium-doped zinc oxide by electrochemical deposition, in accordance with some embodiments.

FIG. 8 is a graph showing the effect of post-deposition annealing temperature in nitrogen and annealing time on sheet resistance of yttrium-doped zinc oxide by electrochemical deposition, in accordance with some embodiments.

In some embodiments, there exists an optimum annealing temperature and annealing time. FIG. 8 shows the measured sheet resistances of yttrium-doped zinc oxide films as a function of annealing time and at different annealing temperatures in nitrogen gas for deposition conditions of: a deposition potential of −0.7 V versus the silver/silver chloride/saturated potassium chloride reference electrode, a deposition time of one hour, a zinc nitrate concentration of 0.1 M, and an yttrium nitrate concentration of 8 mM. Between 200° C. and 400° C., the sheet resistance of yttrium-doped zinc oxide is reduced from 150Ω/□ to 0.5Ω/□, which corresponds to a resistivity of $1.08\times10^{-4}$ Ω-cm for zinc oxide. The sheet resistance of 0.5Ω/□ occurs with a post annealing temperature at 400° C. in nitrogen for 150 minutes.

In light of the principles and example embodiments described and illustrated herein, it will be recognized that the example embodiments can be modified in arrangement and detail without departing from such principles. Also, the foregoing discussion has focused on particular embodiments, but other configurations are contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments.

Similarly, although example processes have been described with regard to particular operations performed in a particular sequence, numerous modifications could be applied to those processes to derive numerous alternative embodiments of the present invention. For example, alternative embodiments may include processes that use fewer than all of the disclosed operations, processes that use additional operations, and processes in which the individual operations disclosed herein are combined, subdivided, rearranged, or otherwise altered.

This disclosure also described various benefits and advantages that may be provided by various embodiments. One, some, all, or different benefits or advantages may be provided by different embodiments.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A method for electrochemical doping in metal oxides and metal chalcogenides, the method comprising:

dissolving a metal precursor into a solution, wherein the metal precursor comprises at least one substance from the group consisting of: cupric sulfate, cupric nitride, and cupric chloride;

controlling the temperature of the solution;

adding a halogen precursor to the solution; and applying a potential between a working electrode and a counter electrode of an electrochemical cell to deposit halogen doped metal oxide film or metal chalcogenide film, wherein the electrochemical cell comprises the working electrode, the counter electrode, and the solution.

2. The method of claim 1, wherein the operation of applying the potential between the working electrode and the counter electrode causes the halogen doped metal oxide film to be deposited on an electrically conductive substrate.

3. A method according to claim 1, wherein the deposited halogen doped metal oxide film comprises halogen doped cuprous oxide.

4. A method according to claim 1, wherein:

the metal precursor comprises a copper precursor; and the method further comprises adding a complexing agent to the solution, adjusting pH of the solution, and performing cyclic voltammetry.

5. The method of claim 4, wherein the complexing agent comprises at least one substance from the group consisting of: lactic acid, acetic acid, malic acid, and dimethyl sulfoxide.

6. The method of claim 1, wherein the halogen precursor comprises at least one substance from the group consisting of: cupric fluoride, cupric chloride, cupric bromide, sodium fluoride, sodium chloride, sodium bromide, sodium iodide, ammonium fluoride, ammonium chloride, ammonium bromide, and ammonium iodide.

7. A semiconductor device, comprising:

a substrate; and a halogen doped metal oxide or metal chalcogenide film on the substrate, the film having been formed by electrochemical deposition, wherein the halogen doped metal oxide or metal chalcogenide film comprises halogen doped cuprous oxide.

8. A method for forming a conductive, substantially transparent substance, the method comprising:

dissolving a zinc precursor into a solution;

controlling the temperature of the solution;

adding an yttrium precursor to the solution; and applying a potential between a working electrode and a counter electrode of an electrochemical cell to deposit yttrium doped zinc oxide, wherein the electrochemical cell comprises the working electrode, the counter electrode, and the solution.

9. The method of claim 8, wherein the zinc precursor comprises zinc nitrate.

10. The method of claim 8, wherein the yttrium precursor comprises yttrium nitrate.

11. The method of claim 8, further comprising annealing the yttrium doped zinc oxide.

12. The method of claim 8, further comprising annealing the yttrium doped zinc oxide in an atmosphere consisting essentially of nitrogen or air.

13. The method of claim 8, wherein the operation of applying the potential between the working electrode and the counter electrode causes the yttrium doped zinc oxide to be deposited on an electrically conductive substrate.

14. The method of claim 8, wherein the operation of applying the potential between the working electrode and the counter electrode causes the yttrium doped zinc oxide to be deposited on an indium tin oxide substrate.

15. A semiconductor device, comprising:

an electrically conductive substrate; and yttrium doped zinc oxide film on the substrate, wherein the yttrium doped zinc oxide film has been formed by electrochemical deposition, wherein the yttrium doped zinc oxide film is conductive and substantially transparent.

16. The semiconductor device of claim 15, wherein the substrate comprises indium tin oxide.

17. The semiconductor device of claim 15, wherein the yttrium doped zinc oxide film has been formed by applying a potential between a working electrode and a counter electrode of an electrochemical cell to deposit yttrium doped zinc oxide.

18. The semiconductor device of claim 15, wherein the yttrium doped zinc oxide film has been formed by electrochemical deposition, followed by annealing.

19. The semiconductor device of claim 15, wherein the yttrium doped zinc oxide film has been formed by electrochemical deposition, followed by annealing in an atmosphere consisting essentially of nitrogen or air.

20. The semiconductor device of claim 15, wherein the electrically conductive substrate comprises a semiconductor substrate.

* * * * *